US006394700B1

(12) United States Patent
Fish

(10) Patent No.: US 6,394,700 B1
(45) Date of Patent: May 28, 2002

(54) HIGHWAY UNDERDRAIN PLASTIC APRON ENDWALL WITH ANTI-FLOATATION WINGS

(75) Inventor: Gary A. Fish, Madison, WI (US)

(73) Assignee: Midwest Plastic Products, Inc., Jefferson, WI (US)

( * ) Notice: Subject to any disclaimer, the term of this patent is extended or adjusted under 35 U.S.C. 154(b) by 0 days.

(21) Appl. No.: 09/621,311

(22) Filed: Jul. 20, 2000

(51) Int. Cl.[7] ..... E01F 5/00

(52) U.S. Cl. ..... 405/124; 405/125; 405/126; 405/112; 404/2; 404/4; 138/96 R

(58) Field of Search ..... 404/4, 2; 405/124, 405/125, 126, 112; 138/96 R

(56) References Cited

U.S. PATENT DOCUMENTS

| | | | | |
|---|---|---|---|---|
| 567,653 | A | * | 9/1896 | Parker |
| 643,677 | A | | 2/1900 | Payne |
| 786,059 | A | * | 3/1905 | Simpson |
| 813,016 | A | | 2/1906 | McHugh |
| 1,850,335 | A | | 3/1932 | Spindler |
| 1,948,016 | A | | 2/1934 | Wilke |
| 2,126,091 | A | * | 8/1938 | Claybaugh |
| 2,334,779 | A | | 11/1943 | Luff |
| 3,587,239 | A | | 6/1971 | Feland |
| 4,360,042 | A | * | 11/1982 | Fouss et al. |
| 4,454,039 | A | | 6/1984 | McCoy |
| 4,490,067 | A | | 12/1984 | Dahowski |
| 4,498,807 | A | | 2/1985 | Kirkpatrick |
| 4,553,874 | A | | 11/1985 | Thomann |
| 4,854,775 | A | * | 8/1989 | Lockwood |
| 4,993,872 | A | * | 2/1991 | Lockwood |
| 5,106,231 | A | | 4/1992 | Thomann |
| 5,252,002 | A | * | 10/1993 | Day |
| 5,360,284 | A | | 11/1994 | Allard |
| 5,427,417 | A | | 6/1995 | Lechuga |
| 5,454,663 | A | | 10/1995 | Stegmeier |
| D368,514 | S | | 4/1996 | Crepeau |
| 5,522,675 | A | | 6/1996 | Gunter |
| 5,536,113 | A | * | 7/1996 | McGregor |
| 5,645,367 | A | | 7/1997 | Gunter |
| 5,803,304 | A | | 9/1998 | Berg |
| 5,803,662 | A | | 9/1998 | Gunter |
| 5,836,717 | A | * | 11/1998 | Bernini |
| D423,088 | S | | 4/2000 | Fish |

OTHER PUBLICATIONS

Specification for Reinforced Concrete Apron Endwall for Pip Underdrain by State Wisconsin, Department of Transportation, 1993.

Specification for Heavy Duty Plastic Apron Endwall.

* cited by examiner

*Primary Examiner*—Heather Shackelford
*Assistant Examiner*—Katherine Mitchell
(74) *Attorney, Agent, or Firm*—Lathrop & Clark LLP

(57) ABSTRACT

A plastic apron endwall is connected to a drain which extends under a highway. The apron endwall is in the form of an upwardly opening trough having a general wedge shape and incorporates lateral wings which extend outwardly from the sides of the apron end wall into the surrounding soil, so that as installed, the soil overburden prevents the apron end wall from being displaced upwardly by buoyancy forces in the event that the ditch into which the apron end wall drains becomes flooded. The total planar area of the wings is selected so that the overburden, that is the soil which lies above the wings, is sufficient to offset any buoyancy force produced by water saturated the soil in which the apron end wall is embedded.

7 Claims, 2 Drawing Sheets

HIGHWAY UNDERDRAIN PLASTIC APRON ENDWALL WITH ANTI-FLOATATION WINGS

CROSS REFERENCES TO RELATED APPLICATIONS

Not Applicable.

STATEMENT AS TO RIGHTS TO INVENTIONS MADE UNDER FEDERALLY SPONSORED RESEARCH AND DEVELOPMENT

Not Applicable.

BACKGROUND OF THE INVENTION

The present invention relates to drainage tiles in general, and to drainage tiles constructed of plastic in particular.

Although perhaps little noticed, drainage pipes or passageways have an ancient history and an important role in supporting the structures upon which civilization is built. A buildup of water within soil can reduce the bearing strength of the soil. A buildup of water can also create large hydraulic forces behind a wall or beneath a road or pavement. Engineers from ancient times have utilized ditches and passageways constructed of stone, wood, and tile to drain water away from foundations, roadways, and fields.

Materials which are utilized for forming drainage passageways should typically be resistant to rot, particularly where used to drain water away from foundations and roadways where the useful life of the structure may be decades or even centuries. Thus the typical materials used have been stone, ceramic tile, and concrete.

Recently plastic has found utility in drainage applications. While plastic may not necessarily be considered as durable as ceramic tile or concrete, in many practical circumstances its inherent properties, including light weight and durability, result in substantial advantages over more traditional materials. The great weight of ceramic and concrete drainage tiles increases the cost of transportation and the difficulty of handling and placing drainage structures. Ceramic tile and, to a lesser extent concrete, are subject to brittle fracture. Although not necessarily always considered in the design of drainage structures, in many real-life situations drainage structure failure is due to impact damage when the structures are dropped. Crushing damage occurs when drainage structures are accidentally driven over, by heavy equipment either before or after placement.

With the advent of the recycle culture, large quantities of certain plastics, particularly polyethylene, have become available. The availability of recycled materials has meant it is cost-effective to use such materials in heavy sections, even where low cost is a consideration.

Plastic as a material of construction finds particular utility in highway underdrain apron end walls. Apron end walls are the structures which receive water from drainage pipes placed under highways to prevent the buildup of water within the foundation of the highway. Thus the apron end walls are exposed at the sides of the road leading into drainage ditches. Their exposure means they are often run over by heavy equipment and at times struck by mower blades. If they are constructed of plastic they are much less subject to damage by heavy equipment and at the same time cause less damage to the mower blades.

Traditional materials used in the fabrication of drainage structures are substantially more dense than water, however plastic tends to be slightly less dense than water. The lower density of plastic means that in a saturated soil, or under flooded conditions within a drainage ditch, it is possible that the buoyant force on an apron end wall could cause an apron end wall to be displaced from its designated position.

What is needed is a plastic aproned end wall which resists movements due to buoyancy forces.

SUMMARY OF THE INVENTION

The plastic apron end wall of this invention incorporates lateral wings which extend out from the sides of the apron end wall so that, as installed, the soil overburden prevents the apron end wall from being displaced upwardly by buoyancy forces in the event the ditch into which the apron end wall drains becomes flooded. The lateral wings extend outwardly from the sides of the apron end wall into the soil which surrounds the sides of the apron. The total planar area of the wings is selected so that the overburden, that is the soil which lies above the wings, is sufficient to offset any buoyancy force produced by water saturating the soil in which the apron end wall is embedded.

It is an object of the present invention to provide a plastic apron end wall which is resistant to buoyant forces.

It is a further object of the present invention to provide an apron end wall which accommodates being constructed of plastic or other lightweight material.

Further objects, features and advantages of the invention will be apparent from the following detailed description when taken in conjunction with the accompanying drawings.

DESCRIPTION OF THE PREFERRED EMBODIMENTS

Figure 1:
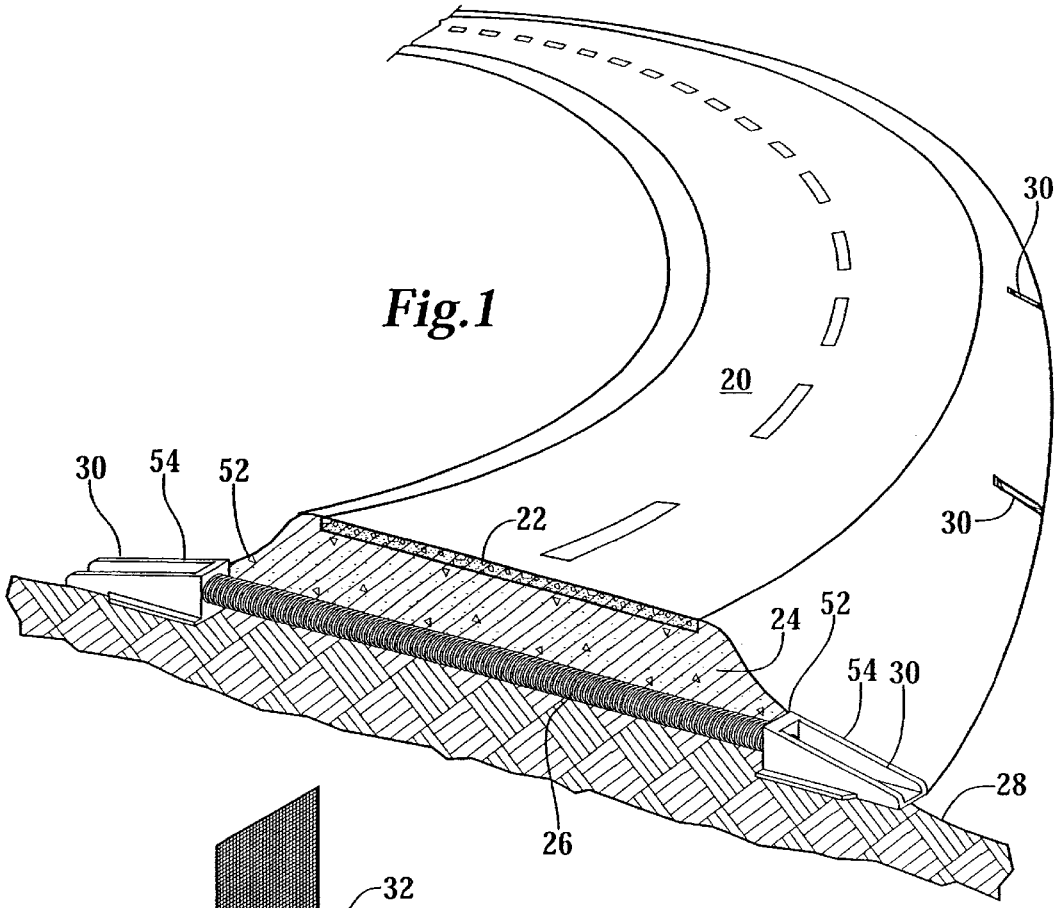
FIG. 1 is a perspective view cutaway to show the apron end wall of this invention in situ.

Referring more particularly to FIGS. 1–7 wherein like numbers refer to similar parts, a highway 20 is shown in FIG. 1. The highway 20 is constructed of a slab of reinforced concrete 22 overlying a gravel foundation 24. The gravel foundation 24 is drained by a plastic underdrain 26 which extends transverse to the Highway 20 emptying into a ditch 28 by way of an apron end wall 30.

It is important to drain the foundation 24 on which a highway 20 is supported in order to prevent, or at least to diminish, damage caused to the highway by a buildup of water within the foundation 24. Where the climate is such that the ground freezes to a certain depth, the absence of water within the foundation is critical to preventing frost heave, wherein the increase in volume experienced by water freezing produces a heaving up of the concrete slab 22.

Figure 2:
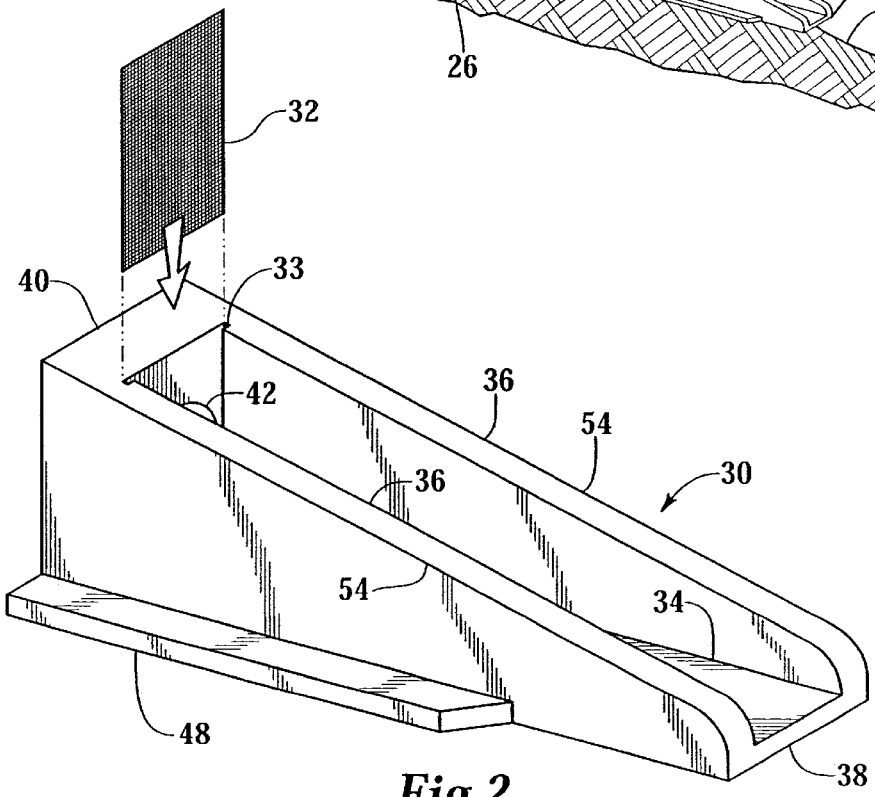
FIG. 2 is an isometric view of the apron endwall of FIG. 1 with a screen exploded away.
Figure 3:
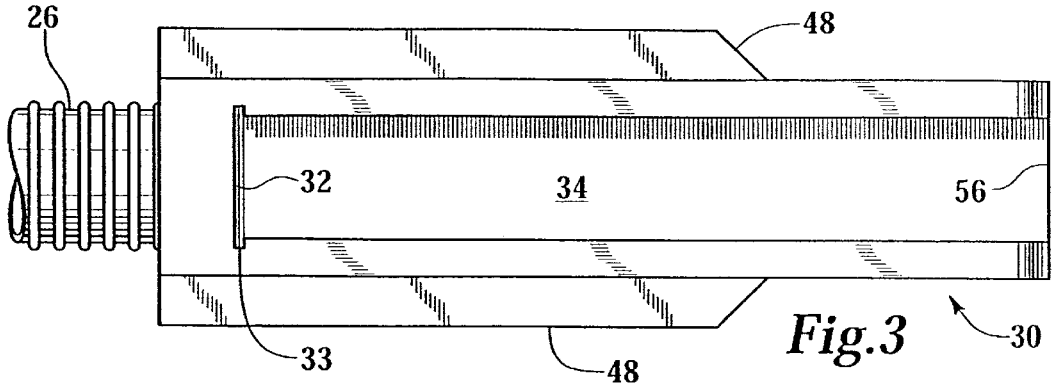
FIG. 3 is a top plan view of the apron endwall of FIG. 1.

It is not desirable for the underdrain 26 to extend out into the ditch. Such an extension would be unsightly, would expose the underdrain to crushing by service equipment, and would provide an undesirable habitat for animals. Therefore, instead of allowing the underdrain to extend outwardly, the tubular underdrain 26 is connected to an apron end wall 30 which leads to the bottom of the drainage ditch 28 so that erosion is prevented. Where ditches are present on both sides of the highway, like apron end walls 30 are connected to the opposite ends of the underdrain 26. The apron end wall 30 may have a screen 32 inserted in a slot 33, as shown in FIG. 2, to prevent the ingress of animals into the underdrain 26. The open nature of the underdrain itself prevents it from becoming a desirable place for animal habitation.

They apron end wall 30 is constructed of plastic, preferably recycled plastic, which is typically high-density polyethylene. The plastic construction of the apron end wall 30 has many benefits. First, the plastic is highly resistant to fracturing or crushing caused by heavy equipment inadvertently driving over the apron end wall 30. Further, as compared to concrete, the cost of manufacture can be reduced because of the high speed with which an injection molded part can be fabricated. The lighter weight part allows placement by hand which in some circumstances may substantially reduce the cost of placement.

Figure 4:
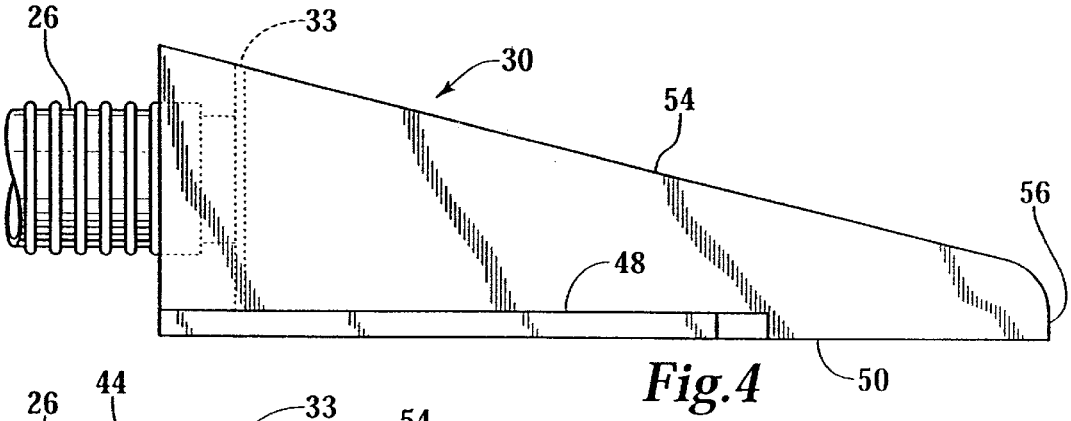
FIG. 4 is a side elevational view of the apron endwall of FIG. 1.
Figure 5:
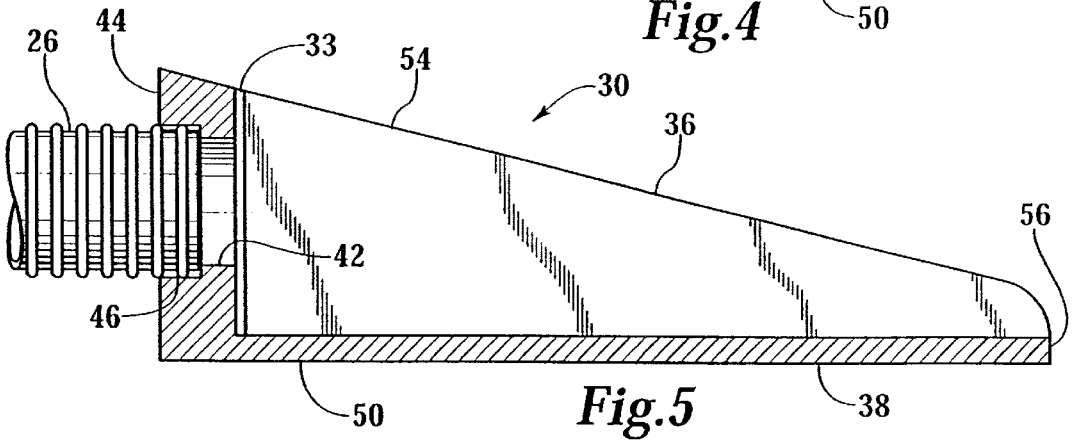
FIG. 5 is a cross-sectional side elevational view of the apron endwall of FIG. 1.
Figure 6:
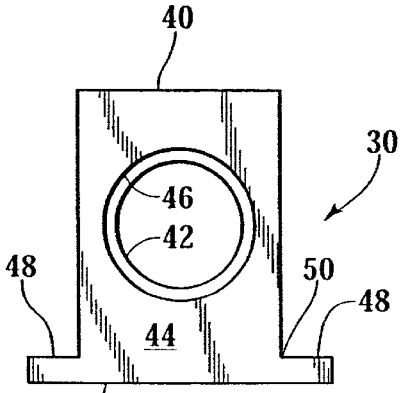
FIG. 6 is a rear elevational view of the apron endwall of FIG. 1.
Figure 7:
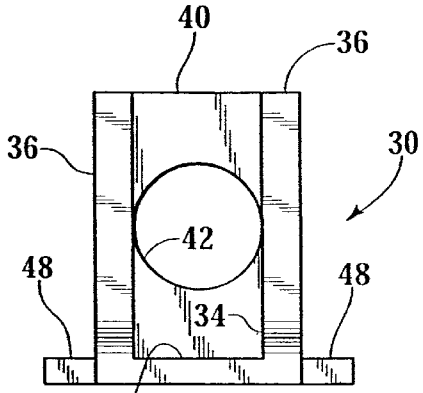
FIG. 7 is a front elevational view of the apron endwall of FIG. 1.

The underdrain 30 has an overall shape which is generally wedge shaped. A central channel 34 is formed between upstanding triangular sidewalls 36 and a bottom wall 38. The underdrain 26 is connected to a back wall 40. The back wall 40 has a circular opening 42 through which water from the underdrain 26 may pass to the central channel 34 and so on into the ditch 28. The circular opening 42 has an enlarged portion 46 which begins at the back side 44 of the wall 40, the enlarged portion receives the underdrain 26 as shown in FIG. 4 and in FIG. 5.

The improvement, constituting the invention, with respect to the apron end wall 30 are horizontal wings 48 extending outwardly from the upstanding triangular sidewalls 36. The horizontal wings 48 extend from the bottom 50 or lower most portions, of the sidewalls 36 and are thus substantially buried in the soil, or overburden 52. As shown in FIG. 1 the apron endwall 30 is buried up to the tops 54 of the sidewalls 36. The wings 48 extend from the backside 44 of the wall 40 and approximately two-thirds of the way forward toward the forward lip 56 of the apron end wall 30. For a typical apron endwall having an overall length of approximately three feet, and a width, not including the wings, of approximately eight inches, the wings extend for about two feet along the sidewalls 36 and extend outwardly from the walls 36 approximately two inches. Thus the total area of the wings 48 is approximately 96 square inches.

Polyethylene has a density varying between about 91 and about 96 percent that of water. Thus when an apron endwall 30 is manufactured from polyethylene, preferably high density polyethylene, there is a possibility that if the ditch 28 into which the end wall 30 drains becomes flooded the endwall 30 could float upwardly through the overburden becoming permanently displaced. The wings 48 are thus sized to support sufficient overburden to hold the endwall 30 in place against the buoyancy force caused by water in the saturated soil surrounding the end wall 30 when the ditch 28 is flooded.

It should be understood that the wings 48 are useful on any apron endwall that is constructed of a plastic which is less dense than water.

For a typical apron endwall such as shown in FIG. 2 having an overall length approximately three feet and a weight of approximately 40 pounds, the buoyancy force will typically be less than about five pounds. Overburden such as overlies the wings 48 will typically have a density of greater than two. If the wings have a total area of 96 square inches and the average depth of burial is about seven inches, the total soil loading will be about 672 cu. in. or about 0.4 cu. ft. After allowing for the buoyancy effect of water on the overburden, about 24 pounds of force are available to overcome the buoyancy force of about five pounds and to hold the apron endwall in place. The area of the wings 48 which is effective to support overburden, is the area of the wings when projected into the horizontal plane, this area will be identical to the area of the wings when the wings extend completely horizontally. Thus the areal extent of the wings is defined to be the area of the wings projected into the horizontal plane.

The buoyant force on an object is determined by the specific gravity of the object in the following equation:

$$w\left(\frac{1}{sg}-1\right)=f$$

where w is the weight of the object in pounds and f is the buoyancy force exerted on the object in pounds and sg is the specific gravity of the object, wherein water has a specific gravity of one.

The areal extent of the wings 48 is a selected so that the overburden 52 supported by the wings is sufficient to overcome the buoyancy effect of the density of the apron endwall 30 being less than that of water. Assuming the apron endwall 30 is buried to the tops 54 of the sidewalls 36, then the average distance between the upper surfaces of the wings 48 and the tops 54 of the sidewalls 36 times the areal extent of the wings times the density of the overburden minus the density of water must be greater than and preferably at least five times greater than the buoyancy force on the apron endwall 30. An equation describing the relationship between the areal extent of the wings and the buoyancy force on the apron endwall can be written:

$$A_w d_{ave} c(sg_o-1) > w_e\left(\frac{1}{sg_e}-1\right)$$

where $A_w$ is the areal extent of the wings;

$d_{ave}$ is the average distance between the upper surface of the wings and the tops of the walls;

c is the weight of a unit volume of water $sg_o$ is the specific gravity of the overburden;

$sg_e$ is the specific gravity of the apron endwall; and $w_e$ is the weight of the endwall.

If $w_e$ is measured in pounds and $A_w$, $d_{ave}$ are measured in the square inches, and inches respectively, then c equals the density of water in pounds per cubic inch or about the 0.036 $lbs/in^3$. Specific gravity is understood to be the density of an object divided by the density of water.

It should be understood that wherein the word "plastic" is used in the specification and claims, it is here used to mean an organic material of the type including polyethylene, this is in contrast to being formed of a material which merely can be plastically deformed at some point during its manufacture, such as clay.

It is understood that the invention is not limited to the particular construction and arrangement of parts herein illustrated and described, but embraces such modified forms thereof as come within the scope of the following claims.

I claim:

1. An apron endwall for a highway underdrain comprising:

a single unitary plastic body having a generally wedge shape, the body having a central channel formed by opposed substantially vertical upstanding sidewalls and a horizontal bottom wall, the unitary plastic body having a back wall, the back wall having an opening through which water from an underdrain may pass to the central channel;

wherein the sidewalls have horizontal wings, of a selected areal extent, which extend outwardly from the sidewalls, and away from the central channel.

2. The apron endwall of claim 1 wherein a portion of the plastic body forms a circular opening leading into the central channel.

3. The apron endwall of claim 1 wherein the plastic body is constructed of high-density polyethylene.

4. The apron endwall of claim 1 wherein the horizontal wings extend outwardly from the sidewalls from a lowermost portion of each side wall.

5. The apron endwall of claim 4 wherein the plastic body is constructed of plastic having a specific gravity of less than one, and the areal extent of the wings is selected so that a quantity of overburden supported by the wings is sufficient to overcome a buoyancy effect produced by the specific gravity of the apron endwall.

6. A system for draining water from a foundation of a roadway comprising:

a road built upon a foundation, the foundation having sides and being made up of material which slopes away from the road;

an underdrain extending transverse to the road, and underlying a portion of the foundation;

an apron endwall having an opening leading to an upwardly opening, uncovered channel, the opening being in water receiving communication with the underdrain, the apron endwall having laterally extending wings which extend away from the upwardly opening channel, the wings being covered by the material which slopes away from the road to an effective depth so as to prevent the apron endwall from floating upwardly when the underdrain is flooded.

7. The system of claim 6 wherein the apron endwall has a weight and is constructed of plastic having a specific gravity of less than one, and the areal extent of the wings is selected so that the material which slopes away from the road and which covers the wings is sufficient to overcome the buoyancy effect caused by the density of the apron endwall, the apron endwall having sidewall tops so that the average distance between the wings and the tops of the walls times the areal extent of the wings times the density of the overburden minus the density of water is greater than the buoyancy force acting upon the apron endwall as described in the equation: (Areal extent of the wings)(average distance between the wings and the tops of the walls)(weight of a unit volume of water)(specific gravity of the overburden −1)>weight of the apron endwall((1/specific gravity of the plastic)−1).

* * * * *